US005267718A

United States Patent [19]

Sheehan

[11] Patent Number: 5,267,718

[45] Date of Patent: Dec. 7, 1993

[54] HANGER STRUCTURE

[75] Inventor: Robert K. Sheehan, Cincinnati, Ohio

[73] Assignee: Indevco Corporation, Cincinnati, Ohio

[21] Appl. No.: 987,248

[22] Filed: Dec. 8, 1992

Related U.S. Application Data

[63] Continuation of Ser. No. 839,820, Feb. 21, 1992, abandoned, which is a continuation of Ser. No. 783,088, Oct. 28, 1991.

[51] Int. Cl.[5] ..... A47G 1/16

[52] U.S. Cl. ..... 248/475.1; 248/217.3; 248/301; 248/466

[58] Field of Search ..... 248/475.1, 466, 217.3, 248/546, 301

[56] References Cited

U.S. PATENT DOCUMENTS

| | | | |
|---|---|---|---|
| 24,586 | 6/1959 | Snyder et al. . | |
| 365,725 | 6/1887 | Buckland . | |
| 559,015 | 4/1896 | Wilmont . | |
| 688,585 | 12/1901 | Brainerd | 248/301 K |
| 841,550 | 1/1907 | Leonard | 248/301 X |
| 930,399 | 8/1909 | Manser . | |
| 1,018,097 | 2/1920 | Claussen . | |
| 1,115,800 | 11/1914 | Froberg . | |
| 1,175,802 | 3/1916 | Orcutt . | |
| 1,297,584 | 3/1919 | Mock . | |
| 1,452,515 | 4/1928 | Kearney et al. . | |
| 1,616,957 | 2/1927 | Honigbaum | 248/217.3 |
| 1,651,392 | 12/1927 | Honigbaum | 248/217.3 X |
| 2,471,584 | 5/1949 | Richards . | |
| 2,693,927 | 11/1954 | Gardner . | |
| 2,757,890 | 8/1956 | Sutton et al. . | |
| 3,282,547 | 11/1966 | Ables . | |
| 3,298,651 | 1/1967 | Passer . | |
| 3,376,911 | 4/1968 | Henning . | |
| 3,433,449 | 3/1969 | Musante | 248/301 X |
| 3,447,823 | 6/1969 | Gregoire . | |
| 3,966,157 | 6/1976 | Corral et al. . | |
| 4,300,745 | 11/1981 | Peterson . | |
| 4,333,625 | 6/1982 | Haug . | |
| 4,613,108 | 9/1986 | Sundstrom et al. . | |

FOREIGN PATENT DOCUMENTS

| | | | |
|---|---|---|---|
| 68420 | 4/1915 | Austria | 248/217.3 |
| 607692 | 7/1926 | France | 248/217.3 |
| 24986 | of 1908 | United Kingdom | 248/546 |
| 188468 | 11/1922 | United Kingdom | 248/217.3 |
| 278545 | 10/1927 | United Kingdom | 248/217.3 |
| 666154 | 8/1929 | United Kingdom | 248/301 |

*Primary Examiner*—David A. Scherbel
*Assistant Examiner*—Derek J. Berger
*Attorney, Agent, or Firm*—Wood, Herron & Evans

[57] ABSTRACT

A single piece hanger structure is provided having a rearwardly extending prongs for mounting the hanger to a wall and a forwardly directed hump situated between upper and lower sets of the prongs to define a prying gap which may be used to pry the hanger from the wall without substantially damaging the wall.

21 Claims, 1 Drawing Sheet

HANGER STRUCTURE

RELATED APPLICATION

This application is a continuation of application Ser. No. 07/839,820, filed Feb. 21, 1992, now abandoned which is a continuation of my design application Ser. No. 07/783,088, filed Oct. 28, 1991, entitled Picture and Utility Hanger, the disclosure of which is incorporated herein by reference.

BACKGROUND OF THE INVENTION

I. Field of the Invention

The present invention relates to hanger structures such as for picture or utility hangers or the like to be fastened to a wall or other surface upon which pictures or other objects are to be supported.

II. Description of the Prior Art

Typical hanger structures such as for hanging pictures, for example, are the common two piece picture hooks consisting of a nail and a formed metal piece held to the wall by the nail, the metal piece having a hooked end on which to support the object t be hanged. Not only is there a problem with these types of hangers of losing and manipulating the separate pieces, but such picture hooks can be cumbersome to use, and removal may be difficult resulting in damage to the wall.

Still other hanger structures require either that a hole be drilled in the wall or that a stud be located so as to anchor the hanger structure and increase its support strength. Such hangers are similarly cumbersome to use or remove and may leave an unsightly hole in the wall requiring significant patch work after the hanger is removed.

Some picture hooks may reduce the risk of lost parts by providing a single piece hanger structure but these devices may still be cumbersome to use and difficult to remove, and further, may have minimal holding strength.

It is desirable to have a hanger structure that has sufficient holding strength while at the same time not requiring special anchoring means or use of a wall stud to achieve that strength. It is further desirable to have a hanger structure which can be easily installed and removed without excessive or unsightly damage to the wall.

SUMMARY OF THE INVENTION

The present invention provides a single piece hanger structure having substantial holding strength yet which is easily installed without separate parts to lose or manipulate and is similarly easily removed with minimal or no damage to the wall. To this end, and in accordance with the principles of the present invention, a one-piece metal member may be formed into a hanger structure such as for hanging pictures by bending back from an upper portion of the member a pair of elongated sharp prongs which may be inserted into the wall to support the member, bending forward a tongue from the lower portion of the member on which to hang a picture or the like, and forming a forwardly projecting hump between the prongs and the tongue to provide a receptacle between the wall and the hanger structure member to receive a pryinq lever, such as a screwdriver, to readily pry the hanger from the wall such that the prongs slide out of the wall with little or no damage to the wall.

The prongs are angled downwardly relative the plane of the wall so as to provide the necessary support for the member when it is mounted to the wall and for the picture or other object supported from the member. Yet, the prongs are generally flat and thus may be slid back out of the wall leaving behind only small slits in the wall. In accordance with one aspect of the present invention, the receptacle provided by the hump allows for easily prying the member away from the wall such that the prongs simply slide out of the wall. To this end, the back surface of the hump is at an angle perpendicular to the prongs such that prying in the receptacle area behind the hump facilitates sliding removal of the prongs. Further, the front of the hump is also preferably flat and perpendicular to the prongs to provide a striking surface in the direction of the prongs whereby to facilitate insertion of the prongs into the wall such as by pressing on the striking surface or hitting it with a hammer or the like.

In accordance with another aspect of the present invention, the hanger member includes one or both of the upper prongs mentioned above and preferably includes one or two additional sharp prongs bent back from the member below the hump so as to position the hump between the upper and lower prongs. Striking the front surface of the hump or prying therebehind facilitates easy insertion and removal of the prongs into or from the wall with little or no damage thereto, yet the hanger has substantial holding strength when mounted to the wall.

In a preferred embodiment, the upper and lower ends of the hanger member are interconnected only by the hump, with the hump including the striking surface and a stand-off portion holding the striking surface perpendicular to the prongs, such that the hump does not collapse when impacted on the striking surface, for example.

In accordance with a yet further aspect of the present invention, the four prongs extend approximately the same length from the hanger structure member so as to define a plane generally parallel to the member. In this way, the hanger structure may be readily held against the wall and aligned for the prongs to be neatly driven into the wall by pressure on the striking surface without wobble or the like. Still further, the top end of the member is preferably provided with a stabilizer plate in the plane of the member from which the upper pair of prongs and hump depend. The stabilizer plate acts as a stop to prevent overinsertion of the prongs into the wall thereby further avoiding damage to the wall.

In accordance with a yet further aspect of the present invention, the prongs extend laterally from the member a distance less than the width of conventional drywall so that when used on drywall which is the predominant wall material used in present day construction, the prongs do not pierce the back side of the drywall. The hanger structure thus does not reduce the integrity of the drywall so that substantial holding support is obtained for the hanger structure. Further, damage to the drywall upon removal of the hanger is minimum.

The tongue on the lower portion may be utilized where a picture hanger structure is desired. However, in accordance with the principles of the present invention, the lower portion of the hanger member may be provided with different structure to support objects other than pictures or may even be connected directly to the object to be supported such as along the bottom edge of the stand-off of the hump.

By virtue of the foregoing there is thus provided a hanger structure with substantial holding strength but which can be easily installed and removed with little or no damage to the supporting wall surface, and which is particularly useful on drywall. These and other objects and advantages of the present invention shall become more apparent from a detailed description of the invention.

BRIEF DESCRIPTION OF THE DRAWINGS

The accompanying drawings, which are incorporated in and constitute a part of this specification, illustrate the invention and, together with the general description of the invention given above and the detailed description given below, serve to explain the principles of the invention.

DETAILED DESCRIPTION OF THE INVENTION

Figure 1:
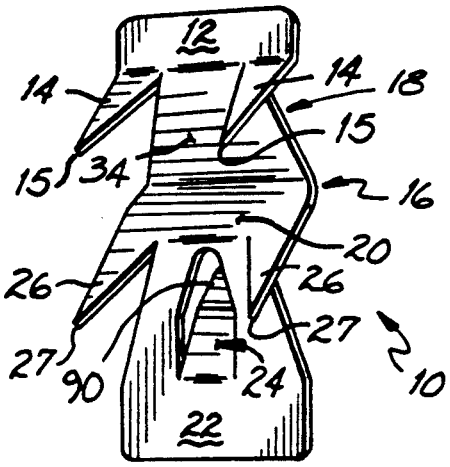
FIG. 1 is a rear perspective view of a picture hanger having the hanger structure of the present invention.

With reference to FIG. 1 there is shown a picture hanger 10 incorporating the hanger structure of the present invention. Picture hanger 10 includes an upper planar, stabilizer plate 12 from which depends a pair of flat plate-like elongated prongs 14 with sharp pointed tips 15 and an oppositely directed hump 16 comprised of upper web or surface 18 and bottom stand-off 20 terminating generally in the plane of stabilizer plate 12. Depending from the bottom of stand-off 20 and in the plane of plate 12 is a support plate 22 which has an up-struck tongue 24 on which a picture or the like may be supported (see FIG. 3). Stand-off 20 also has extending from it in the plane of the stand-off, a second pair of prongs 26 with tips 27 both similar to prongs 14 and tips 15. Prongs 14 and 26 are generally parallel to one another and preferably extend at an angle of about 30° relative the plane defined by plates 12 and 22. Accordingly, when the prongs are driven into a wall 30 to mount picture hanger 10 thereto, plates 12 and 22 are generally parallel and spaced adjacent wall 30 (see FIG. 3).

Figure 3:
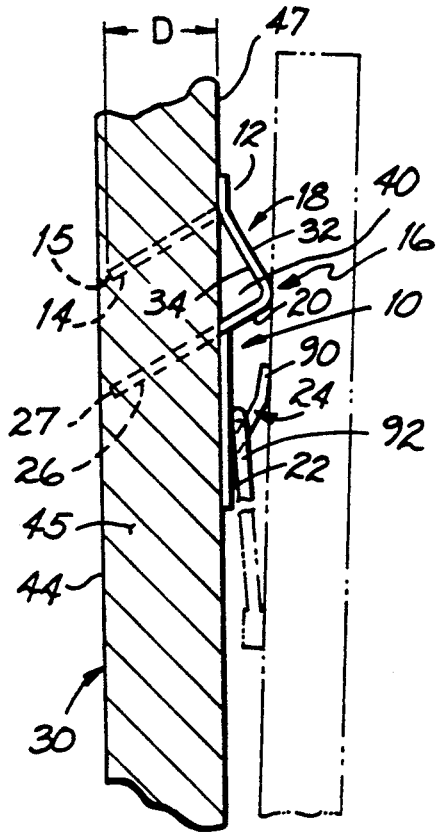
FIG. 3 is a side view of the picture hanger of FIG. 1 mounted to a wall.
Figure 4:
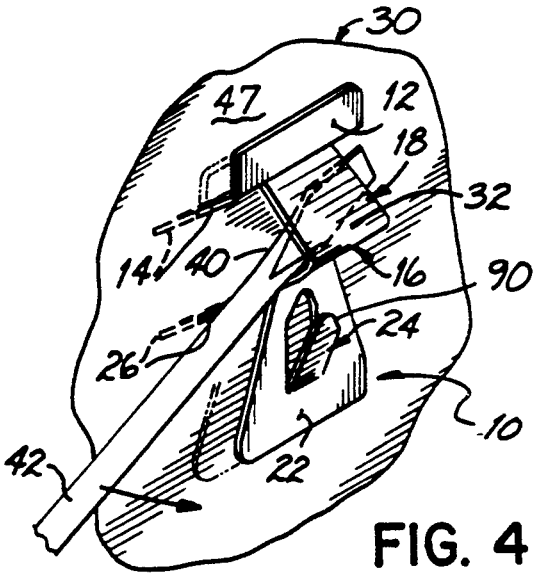
FIG. 4 is a front perspective view of the picture hanger of FIG. 1 mounted to a wall and being pried from the wall.
Figure 5:
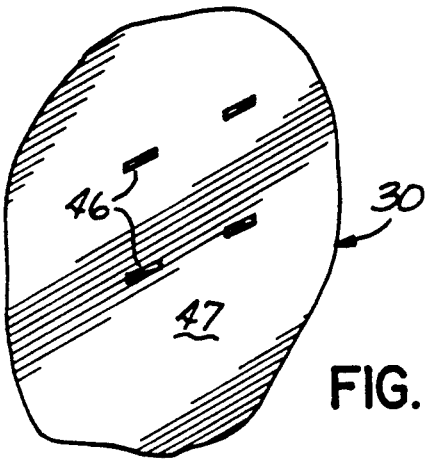
FIG. 5 is a view of the wall of FIG. 3 in the area of the picture hanger after removal of the picture hanger from the wall.

As may be seen in greater detail in FIGS. 3 and 4, web 18 is generally planar and thus has a flat front surface 32 and a flat rear surface 34 extending generally perpendicular relative prongs 14 and 26. Front surface 32 provides a striking surface such that force directed against surface 32 will be parallel to the planes of prongs 14 and 26 to thus drive the prongs into wall 30 to be supported thereby. Once hanger 10 is so mounted, hump 16 defines between wall 30 and back surface 34 a receptacle area 40 into which a prying lever such as a screwdriver 42 or the like (see FIG. 4) may be inserted to pry, by lever action between wall 30 and back surface 34, picture hanger 10 away from wall 30 such that prongs 14 and 26 slide out of wall 30 leaving behind only one small slit 46 for each prong 14 or 26 as seen in FIG. 5. The slits may be unnoticeable or certainly easily repairable after removal of picture hanger 10.

With further reference to FIG. 3, it may be seen that prongs 14 and 26 extend rearwardly from the plane of plates 12 and 22 a lateral distance D, e.g. 0.42 inches, which is less than the thickness of a conventional piece of drywall 30 (e.g. 0.5 inch or more) such that when mounted thereto, prongs 14 and 26 do not pierce the back side 44 of wall 30. Consequently, the plaster material 45 of drywall 30 does not have an opportunity to crumble and fall out of the backside 44 of drywall 30, thereby maintaining the integrity of the drywall and providing a strong base for holding picture hanger 10 thereon. Preferably, the lengths of prongs 14 and 26 are approximately equal so that their pointed tips 15 and 27 rest in a plane that is generally parallel to plates 12 and 22 and to wall 30.

With four such equal length prongs 14, 26 picture hanger 10 may be held against wall 30 prior to securing it to the wall without the hanger wobbling or otherwise slanting to one side. In this way, prongs 14 and 26 of picture hanger 10 can be pushed into wall 30 manually or tapped with a hammer to evenly seat hanger 10 in wall 30 in preparation for further driving the prongs deeper into the wall by a force, such as with a hammer, on striking surface 32. Driving the prongs into wall 30 after first evenly seating picture hanger 10 reduces the width of the slits 46 (See FIG. 5) because prongs 14 and 26 penetrate essentially straight into wall 30 without rocking from side to side as they are driven into the wall.

Figure 2:
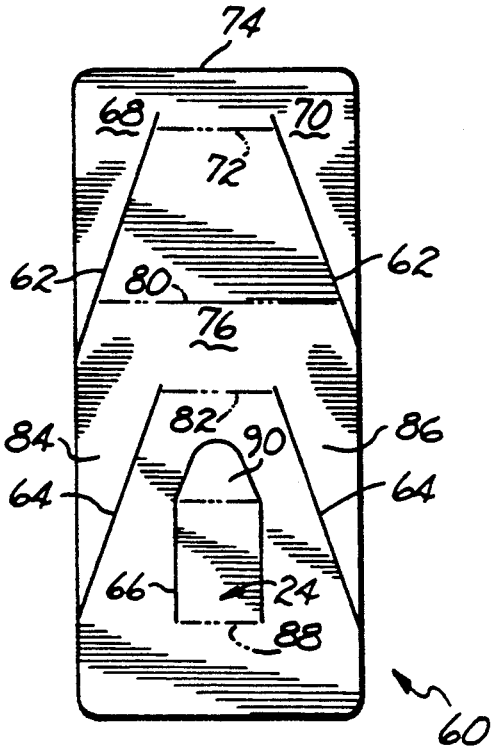
FIG. 2 is a front plan view of a flat metal member from which the picture hanger of FIG. 1 is formed.

With reference now to FIG. 2, it may be seen that picture hanger 10 may be formed from a single metal member 60, such as a Zinc Martensite sheet metal member having lines of cuts 62, 64 and 66 from which prongs 14 and 26 and tongue 24, respectively may be formed. To this end, member portions 68 and 70 are bent rearwardly (into the page as seen in FIG. 2) along bend line 72 parallel top edge 74 of member 60 to thereby define support plate 12 and prongs 14. Center tab portion 76 is bent (out of the page as seen in FIG. 2) also along bend line 72 and then bent rearwardly again along bend line 80 to define web 18 and stand-off 20 of hump 16. Hump 16 terminates at bend line 82 such that plate 22 is suspended from the lower end of stand-off 20 and parallel to stabilizer plate 12. Portions 84 and 86 are bent with stand-off 20 such that they are maintained in the plane of stand-off 20 to define prongs 26 when plate 22 is bent therefrom along bend line 82.

Tongue 24 is bent outwardly along bend line 88 at the bottom of line of cut 66 to an angle of about 30°, and terminus 90 of tongue 24 is bent slightly upwardly inwardly (into the page as seen in FIG. 2) at an angle of about 15° to fully define tongue 24.

As will be appreciated, hump portion 16 is situated between prongs 14 and 26 with supporting structure such as plate 22 and tongue 24 being provided in the bottom portion of hanger 10 to support a picture front or the like suspended by wire 92 received on tongue 24 as seen in FIG. 3. It should be appreciated, however, that plate 22 and tongue 24 could be replaced with different structure for supporting different items and might even include directly connecting the supported item (not shown) to stand-off 20 along bend line 82 such as by welding or being integrally formed with or to the item.

In use, hanger 10 is placed against wall 30 with tips 15 and 27 resting against the front surface 47 thereof. Pressure applied to hump surface 32 drives the prongs 14 and 26 into wall 30 to secure picture hanger 10 thereto as shown in FIG. 3. Since strike surface 32 is perpendicular to prongs 14 and 26, a force against the surface is efficiently transferred downwardly to drive the prongs into the wall with the penetration depth of the prongs limited by plates 12 and 22 to prevent over-penetration into wall 30 which might otherwise damage the surface 47 or backside 44 of wall 30. Referring to FIG. 4, to remove picture hanger 10, a lever or prying device 42, such as a screwdriver, is placed in receptacle area 40 between wall surface 47 and hump rear surface 34. Lever action against wall surface 47 and back surface 34 acts to pry prongs 14 and 26 such that they glide gently out of the wall, leaving thin slits 46 in wall 30 (FIG. 5) which are barely noticeable and easily repairable. Furthermore, since the back surface 34 of hump 16 is perpendicular to the prongs, prying is accomplished without excessive force or gouging of wall 30.

By virtue of the foregoing, there is thus provided a single piece hanger structure having substantial holding strength yet which is easily installed without separate parts to lose or manipulate and is similarly easily removed with minimal or no damage to the wall.

While the present invention has been illustrated by the description of a preferred embodiment, and while that embodiment has been described in considerable detail, it is not the intention of applicant to limit the scope of the appended claims to such detail. Additional advantages and modifications will readily appear to those skilled in the art. For example, while picture hanger 10 is formed by cutting and bending metal plate 60, a hanger structure in accordance with the principles of the present invention could be formed by molding or by joining the portions together. The invention in its broader aspect is therefore not limited to the specific details, representative apparatus and method and illustrative examples shown and described. Accordingly, departures may be made from such details without departing from the scope or spirit of applicant's general inventive concept.

Having described the invention, what is claimed is:

1. A picture hanger comprising a member integrally formed from a single piece of sheet metal, said member including:

upper and lower planar wall-contacting portions which lie adjacent and parallel a wall when the picture hanger is mounted thereto;

a tongue extending forwardly from said lower planar wall-contacting portion for supporting an object when the picture hanger is mounted to the wall;

a plurality of sharp prongs extending downwardly and rearwardly from said upper and lower planar wall-contacting portions for mounting the picture hanger to the wall one of said prongs extending from said upper planar wall-contacting portion and one of said prongs extending from said lower planar wall-contacting portion;

an upper planar web extending downwardly and forwardly from a lower part of said upper planar wall-contacting portion to define a recess behind said upper web, said upper web being vertically disposed between the prong extending from said upper planar wall-contacting portion and the prong extending from said lower planar wall-contacting portion; and wherein said recess defines a space between the wall and an underside of said upper web when said picture hanger is mounted to the wall.

2. The picture hanger of claim 1 wherein the prongs terminate in tips defining a plane generally parallel to said upper and lower planar wall-containing portions.

3. The picture hanger of claim 1 wherein each of the prongs extends generally perpendicular to a plane defined by the upper web.

4. The picture hanger of claim 1 wherein said member further includes a lower web extending inwardly and downwardly from a lower extent of said upper web and back towards said lower planar wall-contacting portion.

5. The picture hanger of claim 4 wherein said prong extending from the lower wall-contacting portion projects from the lower web.

6. The picture hanger of claim 4 wherein two prongs extend from the lower wall-contacting portion, and said two project from the lower web.

7. The picture hanger of claim 1 wherein said member comprises four sharp prongs extending downwardly and rearwardly from said upper and lower planar wall-contacting portions, the four prongs defining a pair of prongs extending from said upper planar wall contacting portion and a pair of prongs extending from said lower planar wall contacting portion, said upper web being disposed between the two pairs of prongs.

8. The picture hanger of claim 7 wherein the prongs are disposed along lateral edges of said member.

9. The picture hanger of claim 1 wherein at least one of the prongs is disposed along a lateral edge of said member.

10. The picture hanger of claim 9 wherein the prongs are disposed along lateral edges of said member.

11. A picture hanger comprising a member integrally formed from a single piece of sheet metal, said member including:

upper and lower planar wall-contacting portions which lie adjacent and parallel to a wall when the picture hanger is mounted thereto;

a tongue extending forwardly from said lower planar wall-contacting portion for supporting an object when the picture hanger is mounted to the wall;

an upper flat prong and a lower flat prong extending downwardly and rearwardly from said upper and lower planar wall-contacting portions, respectively, for mounting the picture hanger to the wall;

an upper planar web extending downwardly and forwardly from a lower part of said upper planar wall-contacting portion to define a recess behind said upper web, said upper web being disposed between said upper flat prong and said lower flat prong; and wherein said recess defines a spaced between the wall and an underside of said upper web when said picture hanger is mounted to the wall.

12. The picture hanger of claim 11 wherein said upper and lower flat prongs terminate in tips defining a plane generally parallel to said upper and lower planar wall contacting portions.

13. The picture hanger of claim 11 wherein each of the prongs extends generally perpendicular to a plane defined by the upper web.

14. The picture hanger of claim 11 wherein said member further includes a lower web extending inwardly and downwardly from a lower extent of said upper web and back towards said lower planar wall-contacting portion.

15. The picture hanger of claim 14 wherein the lower flat prong projects from the lower web.

16. The picture hanger of claim 11 wherein the upper and lower flat prongs are disposed along lateral edges of said member.

17. The picture hanger of claim 11 wherein one of the prongs is disposed along a lateral edge of said member.

18. The picture hanger of claim 17 wherein each of said upper and lower flat prongs is disposed along a lateral edge of said member.

19. A utility hanger adapted to be mounted to a surface, said hanger comprising:

an upper planar surface-contacting portion which lies in a plane adjacent and parallel to a mounting surface when said hanger is mounted thereto;

an upper web extending forwardly and downwardly from said upper planar surface-contacting portion;

a lower web extending inwardly and downwardly from a lower extent of said upper web and back towards said plane, wherein objects may be supported below a lower edge of said lower web;

an upper and a lower sharp prong, said upper prong being connected to said upper planar surface-contacting portion and said lower prong being connected to said lower web, wherein said upper web and said lower web are disposed between said upper and lower sharp prongs to define a recess behind said upper and lower webs, said recess defining a space between said mounting surface and undersides of said upper and lower webs when said hanger is mounted to said mounting surface.

20. The utility hanger of claim 19 wherein said upper web is planar and is generally perpendicular to said upper and lower prongs.

21. The utility hanger of claim 19 wherein a lower planar surface-contacting portion is connected to said lower web and lies in substantially the same plane as said upper planar surface-contacting portion, said lower planar surface-contacting portion including means for supporting objects therefrom.

* * * * *

UNITED STATES PATENT AND TRADEMARK OFFICE

CERTIFICATE OF CORRECTION

PATENT NO. : 5,267,718

DATED : December 7, 1993

INVENTOR(S) : Robert K. Sheehan

It is certified that error appears in the above-identified patent and that said Letters Patent is hereby corrected as shown below:

Column 1, line 23 "t be hanged." should read --to be hanged.--.

Column 1, line 64 "pryinq" should read --prying--.

Column 3, line 19 "invention;," should read --invention;--.

Column 6, line 6 "wall-containing" should read --wall-contacting--.

Column 6, line 32 "at least" should be deleted.

Signed and Sealed this

Twelfth Day of July, 1994

*Attest:*

*Attesting Officer*

BRUCE LEHMAN

*Commissioner of Patents and Trademarks*